United States Patent [19]

Seng et al.

[11] Patent Number: 5,069,082

[45] Date of Patent: Dec. 3, 1991

[54] CONTROLLER FOR POWERED INDUSTRIAL TRUCKS

[75] Inventors: Gert Seng; Gerard Vesin, both of Reutlingen, Fed. Rep. of Germany

[73] Assignee: Wagner Foerdertechnik GmbH & Co. Kg, Fed. Rep. of Germany

[21] Appl. No.: 520,105

[22] Filed: May 7, 1990

[30] Foreign Application Priority Data

Aug. 4, 1989 [DE] Fed. Rep. of Germany ..... 3925872

[51] Int. Cl.[5] ..... G05G 1/04

[52] U.S. Cl. ..... 74/523; 200/61.85; 338/134

[58] Field of Search ..... 74/523, 543, 471 R, 74/553; 180/333, 315; 200/61.85, 293.1, 505, 564; 338/134, 130, 131

[56] References Cited

U.S. PATENT DOCUMENTS

| | | | |
|---|---|---|---|
| 2,815,230 | 12/1957 | Howie | 74/553 |
| 3,190,994 | 6/1965 | Becker et al. | 200/61.85 |
| 3,611,245 | 10/1971 | Puerner | 338/134 |
| 3,823,616 | 7/1974 | Houseman et al. | 74/471 R |
| 3,941,009 | 3/1976 | Brown | 74/543 |
| 3,979,967 | 9/1976 | Dunlap | 74/553 X |
| 4,180,713 | 12/1979 | Gonzales | 180/333 X |
| 4,308,433 | 12/1981 | Edwards, Jr. | 338/134 X |
| 4,334,130 | 6/1982 | Beig | 200/61.85 X |
| 4,380,938 | 4/1983 | Olson | 74/523 X |

*Primary Examiner*—Rodney M. Lindsey
*Attorney, Agent, or Firm*—McGlew & Tuttle

[57] ABSTRACT

The disclosure relates to rotary handle controls using control circuits for controlling powered industrial trucks particularly stacking vehicles. Specifically, hand controls to effect a simultaneous actuation of several functions with one hand are disclosed. The circuitry embodys the use of potientiometer shafts to allow for one hand control.

9 Claims, 1 Drawing Sheet

Fig.1
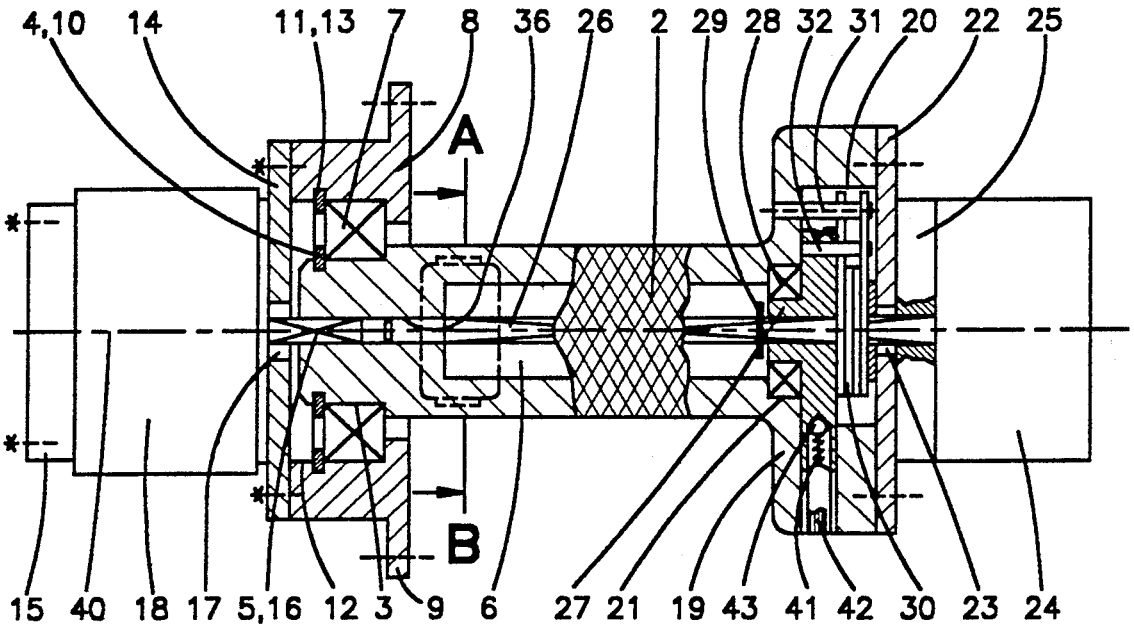
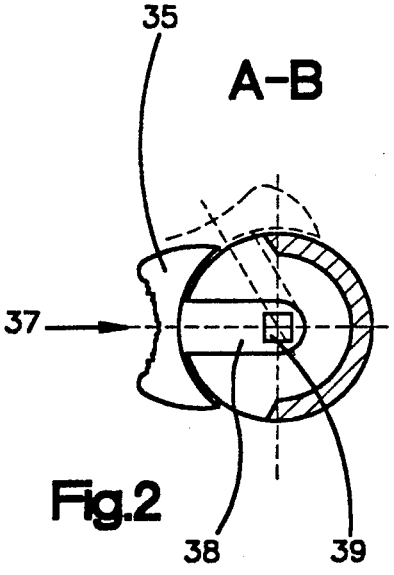
Fig.2
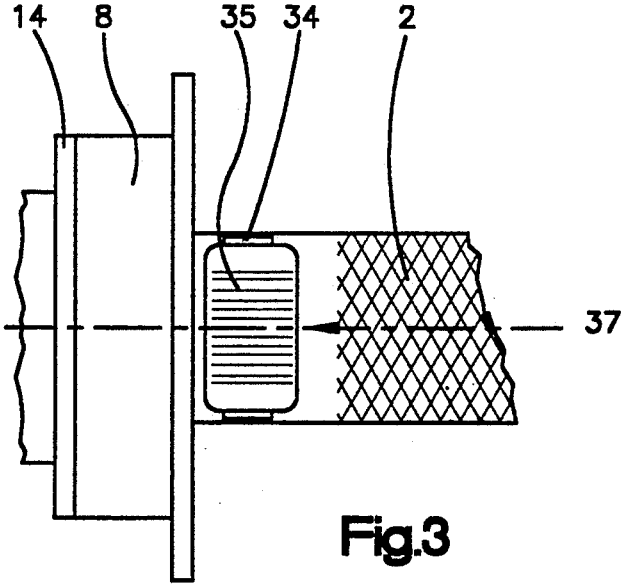
Fig.3

CONTROLLER FOR POWERED INDUSTRIAL TRUCKS

BACKGROUND OF THE INVENTION

The invention relates to a controller for powered industrial trucks, especially stacking vehicles, with a rotary handle for the continuous actuation of a first and second function.

Known controllers for powered industrial trucks are usually in several parts, dependent on function. As soon as more than one vehicle function must be controlled by such controllers, both hands of the operator are required. As a result, simultaneous steering of the vehicle is prevented, so that operating the functions of the vehicle requires, in principle, stopping the vehicle.

Controllers are already known in which one vehicle function, for example the travel command, is actuated continuously through a rotary handle, and another vehicle function, for example the lifting and lowering of the load carriage, is actuated by actuation of pressure or rocker switches lying just outside the rotary handle. This gives the operator difficulty in operating either the rotary handle or the pressure or rocker switch, since the latter, upon rotation of the rotary handle, often comes to lie outside the reach of the operator's thumb (normally used for this purpose) and thus cannot be operated at the same time. In this way, a super-imposing of these vehicle functions or the resultant simultaneous cycles of movement, are prevented. Further, such devices usually require a number of separate control circuits, corresponding to the individual switches.

Controllers in which pressure switches or pressure knobs are already arranged directly on the rotary handle, for example on the end of same, exclude a continuous regulation of function.

This is also the case with a pilot control device, disclosed in German Utility Model 78 22 523, which consists of a T-shaped setting lever, and a plurality of pressure knobs or selection levers arranged thereon, which are inconvenient to operate and do not exclude failed operations.

SUMMARY OF THE INVENTION

It is an object of the invention to addresses the problem of providing, at low expense in means and costs, a controller which is for powered industrial trucks and especially for a stacking vehicle, which is more secure in operation and, in particular, of greater stability ergonomically which makes possible a simultaneous actuation of several vehicle functions with one hand, without the hand having to release the controller at any point in time, and which, at the same time, can serve the operator as a hand hold during travel movements of the powered industrial truck.

The object thus stated is solved by the fact that the rotary handle is designed as a multi-function handle for simultaneous one-hand operation of all the functions dependent on steering of the powered industrial truck, and on its circumference, in the reach of the thumb of the operator, has a signal emitter for continuous and/or finely graduated actuation of the lifting device. The ergonomic integration of the lift controller directly in the travel controller makes possible a simultaneous one-hand operation of both, and, as a result, superimposed cycles of movement of the lifting mechanism and the industrial truck, without any interruption of the simultaneous process of steering the industrial truck with the other hand. Because of its stable structure, the rotary handle may be used additionally as a holding handle and for driver support, in starting or braking and in curved travel of the industrial truck, without danger of impairing existing function regulation or unexpectedly starting new functions. For easier operation, the signal emitter is designed as a potentiometer movable circumferentially in both directions, which also facilitates the continuous actuation of the lifting switch.

In a further development of the idea of the invention, the travel switch and the lift switch are arranged opposite each other on both sides of the rotary handle, and equipped with potentiometers, whereby an especially space-saving compact design, with a minimum of circuitry expense, can be attained.

One advantageous embodiment of the invention is distinguished by the fact that the potentiometer shafts are both independently rotatably disposed within the rotary handle with the shaft of the travel switch potentiometer being rotatable with the rotary handle and the potentiometer shaft of the lift switch being rotatable against a spring bias with the slide regulator. Besides attaining a shorter setting distance, this provides also, in particular, for a continuous regulation.

This latter advantage is also provided, in particular, by a preferred geometric structure, in which the signal emitter is arranged in the center of an arcuate opening in the rotary handle and is provided with a radial setting tongue, through which the potentiometer shaft extends centrally into the longitudinal axis of the rotary handle.

Other advantageous embodiments of the invention are return springs which return the rotary handle and the signal emitter to predetermined positions whenever the operators hand is removed from the controls. This predetermined position is usually a stop position so that loss of control of the industrial truck does not occur if the operator is absent. Another advantageous feature is catch openings on the potentiometer shaft of the signal emitter. These catch openings in connection with a preloaded spring ball catch makes possible a graduation of setting steps which can be varied from barely perceptible to large enough to be only bridged by increased finger force. This variation is occurred by changing the preload of the spring ball catch.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

FIG. 1 shows a longitudinal section through a rotary handle of a controller according to the invention.

FIG. 2 shows a cross section through the rotary handle along the section line A-B in FIG. 1.

FIG. 3 shows a detail top view of the rotary handle of FIG. 1.

DESCRIPTION OF A PREFERRED EMBODIMENT

A rotary handle 1 (FIG. 1) is equipped with a slip-proof gripping surface 2, which preferably extends over the entire circumference and the entire length of the rotary handle 1. To increase the gripping strength, the gripping surface 2 is provided with a rough or grooved or possibly rubberized coating, or instead of this with a knurled surface structure. At one end of the rotary handle 1 is a shaft offset 3, in which is formed an outer circular groove 4. A bore 5, with a bottom shaped as an inner rectangle, is formed centrally in the shaft offset 3.

On the shaft offset 3 there is disposed, by means of a ball bearing 7, a bearing pot 8, which for the purpose of fastening the controller to the powered industrial truck, has on its outer diameter a flange 9. The ball bearing 7 and the bearing pot 8 are secured by two holding rings 10 and 11 against axial movement. An outer holding ring 10 is in the outer ring groove 4 of the shaft offset 3, and an inner holding ring 11 is set into an inner ring groove 13 of the bearing pot 8.

A travel switch 18 is screwed onto the end of the bearing pot 8 by means of a bearing cover 14. The travel switch 18 contains, among other things, a first potentiometer 15, having a potentiometer shaft 16, and produces, in the known way, through a pulse control, driving signals, such as "FORWARD", "STOP", and "REVERSE", for energizing at least one drive motor. The potentiometer shaft 16 has a rectangular cross-section. The shaft 16 extends through an opening 17 of the cover 14, and is received in the inner rectangular bore 5 of the shaft offset 3.

On its end opposite the travel switch 18, the rotary handle 1 widens into a bearing shell 19 with an inner opening 20. Directed toward the wall of this opening 20 of the bearing shell 19 is arranged a spring-loaded ball catch 41, the spring tension of which can be varied by means of a set screw 42. The opening 20 terminates in a bearing seat 21, which passes into a long bore 6.

Onto the bearing shell 19 is screwed a bearing cover 22, with a central opening 23. To the bearing cover 22 is fastened a lift switch 24, which includes, among other things, a second potentiometer 25 having a potentiometer shaft 26, and which produces lift signals in a known manner, through a pulse control, such as "LIFT", "STOP", and "LOWER", for energizing at least one lift motor.

The travel switch 18, the lift switch 24, the potentiometers 15 and 25, and the drive and lift motors, are known commercial parts and therefore need not be represented and described, or only schematically.

The potentiometer shaft 26 extends through the opening 23 in bearing cover 22, for the entire length of the bore 6, and is supported at its end in a bore 36 located centrally in the bottom of the bore 6. The potentiometer shaft 26 is formed, over the entire length of the bore 6, as a rectangular shaft with its end supported concentric in the bore 36. In the bearing shell 19, the potentiometer shaft 26 is guided in a bearing bushing 27 which, in turn, is supported by means of a ball bearing 28, arranged on the bearing seat 21. Inwardly of the bearing bushing 27, the potentiometer shaft 26 is secured against axial movement by a securing ring 29.

In the exterior surface of the bearing bushing 27 there are formed--distributed over its circumference--cap-, ball-or triangle-shaped catch openings 43, which cooperate with the spring-biased ball catch 41 of the bearing shell 19. The number and spacing of the catch openings 43 depend on the desired number of fine graduations of the setting steps, while their perceptibility can be varied, down to a continuous transition, by varying the depth of the catch openings 43 and/or the spring force of the ball catch 41 (FIG. 1).

In the opening 20 of the bearing shell 19 a second return spring 30 is arranged, on the bearing bushing 27. The return spring 30 is designed as a spreading spring, one end of which lies against a stop 31 fixed in the bearing shell 19, and the other end against a carrier 32 fastened into the bearing bushing 27 (FIG. 1). In an equivalent manner with a second spring 44 for returning the handle 1 to a zero position, the potentiometer shaft 16 may be spring-loaded.

Since only the bores and the openings may need to be finely finished, the rotary handle 1 is preferably cast, for example, in aluminum. Naturally, the rotary handle 1 may also be made as a turning on a lathe.

As shown in FIG. 2, in the region of the bore 6, preferably aligned with its bottom, there is formed in the circumference of the rotary handle 1 an arc-form opening 34. In this latter is received a signal emitter 35, which is preferably designed as a slide regulator with a knurled surface and which, as seen in FIG. 3, is slightly wider than the arc-form opening 34, so that its edge lies on the circumference of the rotary handle 1.

The signal emitter 35 has a setting tongue 38 extending radially into the bore 6 of the rotary handle 1, and having a rectangular opening 39. Through the rectangular opening 39 extends, along the longitudinal central axis 40 of the rotary handle 1, the rectangular potentiometer shaft 26. A set screw (not shown) secures the setting tongue 38 of the signal emitter 35 on its underside against the potentiometer shaft 26 in a known manner.

Starting from a middle zero position 37, the signal emitter 35 can be moved circumferentially to both sides, against the force of the return spring 30, by a given angle either continuously or in fine gradations, as shown in FIG. 2 in dot and dash lines.

How the controller according to the invention works is explained in detail below.

By rotating the rotary handle 1 to the left or right, preferably by means of the right hand of the operator, the potentiometer shaft 16 of the travel switch 18 is rotated, and thus produces varying voltage values, which after processing in the pulse control, are used for starting the travel motor. Since the other hand, preferably the left, is taken or used for steering the industrial truck, it has been difficult, up to now, to carry out a superimposed movement of the lift mechanism, simultaneous with the production of the travel signal during travel. By movement with the thumb of the signal emitter 35, integrated directly into the rotary handle 1, the operator can now, without needing to use his hand, produce additional superimposed lift mechanism signals, so that, in this way, simultaneous steering, driving, and actuation of the lift mechanism for the industrial truck are possible.

Selection of the depth of the catch openings 43, in connection with selection of the degree of spring preload of ball catches 41, which engage the latter upon movement of the signal emitter 35, makes possible both a graduation of the setting steps which is very perceptible to the operator, in which the particular catch positions can only be bridged over by the use of increased finger force, as well as a relatively continuous slide regulation, undetectable without the use of measurement technology, merely by feel.

As shown in FIG. 1, the spring-biased ball catch 41 can be brought selectively, by the set screw 42 or other mechanical means, out of engagement with the catch openings 43, making possible an absolutely continuous movement of the signal emitter 35. This can also be done simply by providing a rest position, in which the spring-loaded ball catch 41, for the purpose of relieving and releasing its catch ball, can be, selectively, completely lifted out of its catch position.

Since the rotation of the potentiometer shafts 16 and 26 takes place against spring force, in an emergency, the operator can bring to an immediate stop the movement cycles begun, individually or together, simply by releasing the rotary handle 1 and/or the signal emitter 35. Thus, the signal emitter 35, for example, is automatically brought back into its zero position 37, since the force of the return spring 30 is far greater than that of the ball catch 41, and thus lifts off the latter. In this way, operation errors are, in principle, fully excluded, and the operator can concentrate fully on the cycle of movements of his vehicle, induced by him, or on the loading and unloading processes.

Because of the strong cast construction, the rotary handle 1 can additionally be used by the operator, during driving movements of the industrial truck (especially in acceleration and braking, as well as on curves) as a stabilizing holding handle or as a side support.

Naturally, the invention is not limited to the example of execution shown in the figures and included in the description. Obviously, many variations of construction, such as other shaping and arrangement of the signal emitter 35 on the rotary handle 1, the use of equivalent setting elements or catch means, the use of signal producers operating on a different physical basis, and fine graduation of the setting steps through the use of cam-operated limit switches also lie within the invention.

We claim:

1. A one hand controller for independently controlling a first and second function, the controller comprising:

a support;

a handle rotatably mounted on a first end to said support and freely suspended on an opposite second end;

a first function potentiometer continuously measuring rotation of said handle and controlling the first function dependent upon said measured rotation;

signal emitter means slidably mounted on a circumference of said handle and rotatably adjustable independent of said rotation of said handle;

a second function potentiometer continuously measuring movement of said signal emitter means and controlling the second function dependent on said measured movement;

a first function spring means mounted between said handle and said support for returning said handle to a predetermined position upon removal of torque to said handle; and a second function spring means mounted between said handle and said signal emitter means for returning said signal emitter means to a predetermined position upon removal of torque to said signal emitter means.

2. A controller in accordance with claim 1, wherein: said first function potentiometer is mounted on said first end of said handle and said second function potentiometer is mounted on said opposite end.

3. A controller in accordance with claim 1, further comprising:

first and second potentiometer shafts connected to said first and second function potentiometers respectively, said first and second potentiometer shafts being rotatable independently of each other and integrated into said handle.

4. A controller in accordance with claim 1, wherein: said handle is perpendicular to said support.

5. A controller according to claim 1, wherein said signal emitter is arranged in the middle of an arc-form opening of said handle and said signal emitter is provided with a radial setting tongue to which the second function potentiometer is connected centrally, in a longitudinal axis of said handle.

6. A controller in accordance with claim 1, further comprising:

a bushing in said handle for guiding said signal emitter means, said bushing having selectively engagable and detachable locking means with a degree of engagement being adjustable from setting steps to a continuous slide regulation.

7. A controller according to claim 6 further comprising: a spring-biased ball catch which is in working connection with catch openings on said bushing.

8. A controller according to claim 7 wherein: said ball catch can be detached selectively from a catch position into a rest position.

9. A one hand controller for independently controlling a first and second function, the controller comprising:

a support;

a handle rotatably mounted on a first end to said support and freely suspended on an opposite second end;

a first function measurement means continuously measuring rotation of said handle relative to said support and controlling the first function dependent on said measured rotation;

a signal emitter means slidably mounted on a surface of said handle;

a second function measurement means mounted on said handle, continuously measuring movement of said signal emitter means relative to said handle and controlling the second function dependent upon said measured movement.

* * * * *